US005947874A

United States Patent [19]

Dougherty

[11] Patent Number: 5,947,874

[45] Date of Patent: Sep. 7, 1999

[54] ELLIPTICAL SIMULATED STAIR CLIMBING EXERCISE DEVICE

[76] Inventor: Wayne Dougherty, 620 The Village #103, Redondo Beach, Calif. 90277

[21] Appl. No.: 09/158,864

[22] Filed: Sep. 23, 1998

[51] Int. Cl.[6] ..... A63B 22/04; A63B 21/00

[52] U.S. Cl. ..... 482/62; 482/52

[58] Field of Search ..... 482/51, 57, 62, 482/148, 64, 65, 63, 37, 52, 53

[56] References Cited

U.S. PATENT DOCUMENTS

| | | | |
|---|---|---|---|
| 4,688,791 | 8/1987 | Long | 482/62 |
| 4,693,468 | 9/1987 | Kurlytis et al. | 482/62 |
| 4,842,269 | 6/1989 | Huang | 482/62 |
| 5,044,627 | 9/1991 | Huang | 482/62 |
| 5,540,637 | 7/1996 | Rodgers, Jr. | 480/52 |
| 5,685,804 | 11/1997 | Whan-Tong | 482/51 |
| 5,738,614 | 4/1998 | Rodgers | 482/51 |
| 5,759,136 | 6/1998 | Chen | 482/57 |
| 5,857,943 | 1/1999 | Murray | 482/57 |

*Primary Examiner*—Stephen R. Crow
*Attorney, Agent, or Firm*—Goldstein & Canino

[57] ABSTRACT

An exercise device, for simulating elliptical motion of stair climbing, comprising a frame having a front support and a rear support, and comprising upper and lower exercise units. The front support and rear support meet at an apex where they form an acute angle. The exercise units each comprise a pair of elliptical guide tracks which each form a closed loop. A pair of actuating levers are each attached onto the guide tracks by a partial sleeve which is capable of travel around said loop. Each exercise unit also comprises a flywheel assembly which each has a pair of flywheels mounted to the rear support. Each flywheel is attached to one of the actuating levers by a connecting lever. The flywheels are shaped and the connecting levers are connected to the flywheels so as to permit elliptical motion of the actuating levers around the guide track.

6 Claims, 2 Drawing Sheets

ELLIPTICAL SIMULATED STAIR CLIMBING EXERCISE DEVICE

BACKGROUND OF THE INVENTION

The invention relates to an elliptical simulated stair climbing exercise device. More particularly, the invention relates to an exercise device which simulates the natural motion present in stair climbing by employing an elliptical field of motion.

Once exercise began booming in the '80s, people began to seek new ways to exercise. Stair climbing became a popular form of cardio-vascular activity. However, stairs suitable for stair climbing is not always available. In fact in many regions, stairs in general are rare. Further, exercising on stairs can be dangerous. As one tires, the risk of misstepping and falling down the stairs increases drastically.

Accordingly, stair climbing machines were devised to simulate the stepping motion of climbing stairs. The simulated stair climbing machines generally consist of a pair of pedals which are allowed to travel upward and downward, offering variable resistance to the user. Although these machines do provide cardiovascular exercise to the user, the linear motion they provide does not exercise all of the same muscles as with actual stair climbing.

U.S. Pat. No. 5,759,136 to Chen discloses an exercise device which includes a pair of levers and a pair of cranks pivotally secured on a base and a pair of beams secured between the levers and the cranks for allowing the beams to move along a circular path. A pair of foot supports are slidably engaged on the beams and are moved along the beams for allowing the foot supports to move along an elliptical path.

U.S. Pat. Nos. 5,738,614 and 5,540,637 to Rodgers disclose a stationary exercise apparatus with retractable arm members. U.S. Pat. No. 5,685,804 to Whan-Tong et al., discloses a stationary exercise device which employs a pair of foot engaging links supported for rotational movement about a pivot axis.

Other devices have been devised which are used by a person standing upright, but are similar to an exercise bicycle, in that they dictate that the legs follow a circular field of motion that does not simulate the motion of stair climbing.

While these units may be suitable for the particular purpose employed, or for general use, they would not be as suitable for the purposes of the present invention as disclosed hereafter.

SUMMARY OF THE INVENTION

It is an object of the invention to produce an exercise device which simulates stair climbing. Accordingly, the exercise device has pedals which follow an elliptical field of motion that mimics the foot motion during actual stair climbing.

It is another object of the invention to provide an exercise device which simultaneously provides exercise for the arms and for the legs. Accordingly, handholds are provided which also follow an elliptical field of motion.

It is a further object of the invention to provide an exercise device which allows the person to stand upright while exercising, and maintain a posture similar to that used while actually climbing stairs. Accordingly an upright frame is provided which has upper exercise unit and lower exercise unit attached thereto, and positioned so as to allow a comfortable posture while standing upon the pedals of the lower exercise unit and grasping the handgrips of the upper exercise unit.

It is a further object of the invention to provide an exercise device having a simplistic construction so that the device is essentially maintenance free, and has a long useful life.

The invention is an exercise device, for simulating elliptical motion of stair climbing, comprising a frame having a front support and a rear support, and comprising upper and lower exercise units. The front support and rear support meet at an apex where they form an acute angle. The exercise units each comprise a pair of elliptical guide tracks which each form a closed loop. A pair of actuating levers are each attached onto the guide tracks by a partial sleeve which is capable of travel around said loop. Each exercise unit also comprises a flywheel assembly which each has a pair of flywheels mounted to the rear support. Each flywheel is attached to one of the actuating levers by a connecting lever. The flywheels are shaped and the connecting levers are connected to the flywheels so as to permit elliptical motion of the actuating levers around the guide track.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
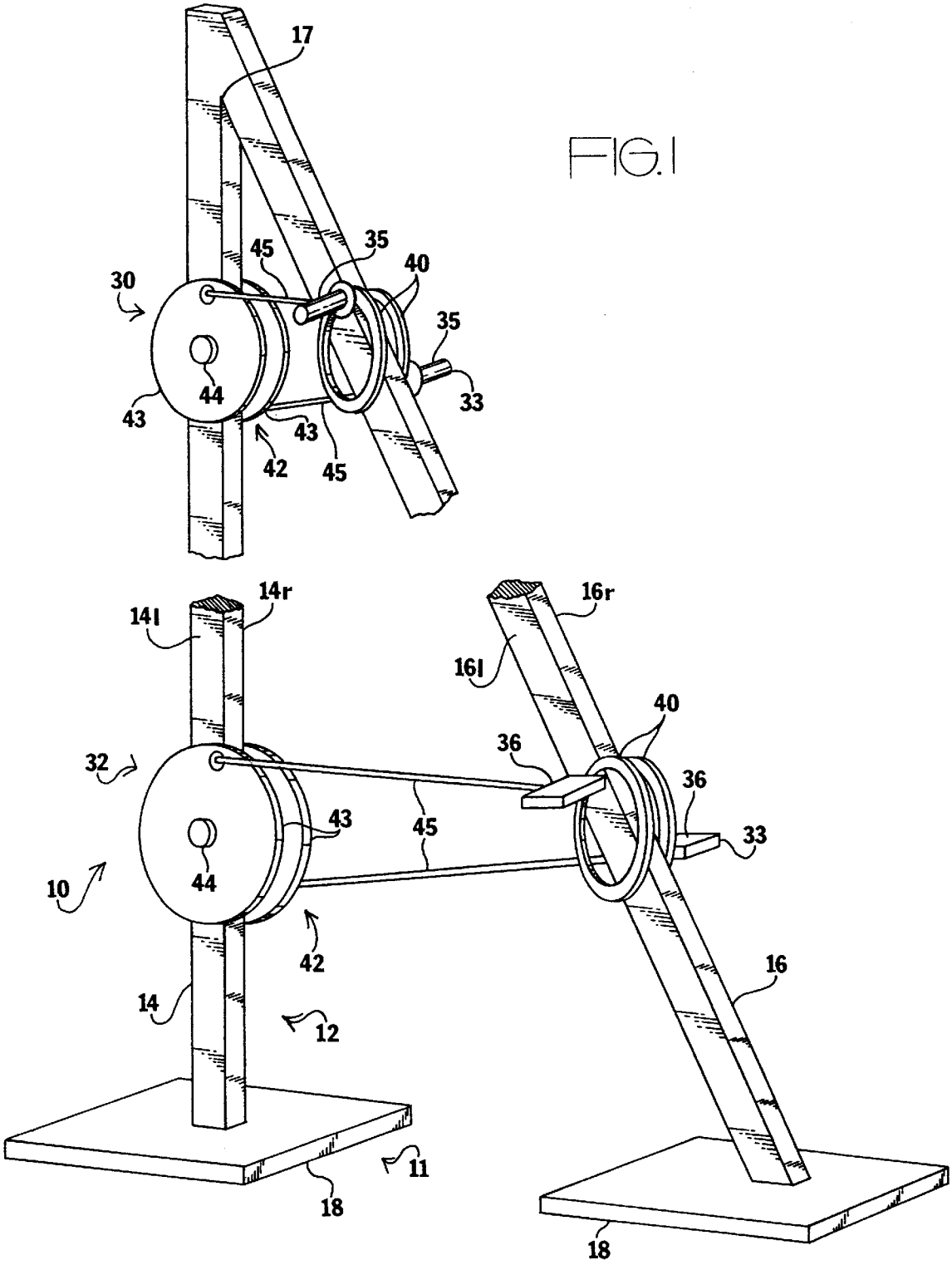
FIG. 1 is a diagrammatic perspective view of the invention, wherein a break is shown to illustrate that the invention has a greater height than can be properly illustrated with detail in the drawing figure.

FIG. 1 illustrates an exercise device 10, comprising a base 11 and a frame 12. The frame comprises a rear support 14 and a front support 16. The base 11 comprises a pair of base plates 18. The rear support 14 and the front support 16 are each supported by one of the base plates 18, which provides stability for the frame 12. The rear support 14 and front support 16 meet at an apex 17, where the rear support 14 and front support 16 form an acute angle of preferably ten to thirty degrees.

The front support 16 has a pair of opposite sides, namely a front support left 16L and a front support right 16R. The rear support 14 also has a pair of opposite sides, namely a rear support left 14L and a rear support right 16R.

The exercise device 10 comprises an upper exercise unit 30 and a lower exercise unit 32. The upper exercise unit 30 and lower exercise unit 32 both have a pair of actuating levers 33. However, in the case of the upper exercise unit 30 the actuating levers 33 are handgrips 35, while in the lower exercise unit 32 the actuating levers 33 are pedals 36. In most other respects, the upper exercise unit 30 and lower exercise unit 32 have the same overall configuration.

Each exercise unit 32 comprises a pair of elliptical guide tracks 40 mounted to the front support 16, and a flywheel assembly 42 mounted to the rear support. One of the guide tracks 40 is mounted to the front support left 16L and the other is mounted against the front support right 16R.

The flywheel assembly 42 comprises a pair of flywheels 43 and an axle 44 attaching the two flywheels 43 so that they rotate together. One of the flywheels 43 is mounted against the rear support left 14L and the other flywheel 43 is mounted against the rear support right 16R.

The flywheel assembly 42 is linked to the actuating levers 33 by a pair of connecting levers 45. More particularly, each of the connecting levers 45 are attached between one of the actuating levers 33 and one of the flywheels 43. The flywheel 43 on the rear support left 14L is thereby attached to the actuating lever 33 on the front support left 16L. The flywheel 43 on the rear support right 14R is thereby attached to the actuating lever 33 on the front support right 16R.

In general, the shape of each flywheel 43 and the connection between the connecting lever 45 and its associated flywheel 43 must be made on a point on the flywheel so as to allow motion of the actuating lever 33 on the guide track 40. In other words, since the actuating lever 33 must follow an elliptical path on the guide track, the flywheel 43 and the connection thereto must be made to permit similar elliptical motion of the actuating lever 33. Configuration of the flywheel to produce the desired cam action is well within the knowledge of those of ordinary skill in the art, and thus the specific design of the flywheel is beyond the scope of this patent, and need not be discussed herein.

The flywheel assembly 42 provides resistance for the user by requiring that the user overcome the static inertia of the flywheels 43 in order to begin motion. In addition, the axle 44 can contain resistance means for adding dynamic resistance to increase the level of difficulty for the user.

The relative position of the upper exercise unit 30 and lower exercise unit 32 is selected so that an adult can comfortably stand upon the pedals 36 of the lower exercise unit 32, while they grasp the handgrips 35. In addition, the guide tracks 40 are generally smaller and the flywheels 43 are generally smaller and lighter in weight for the upper exercise unit 30 compared to corresponding components in the lower exercise unit 32 due to the smaller range of motion necessary for exercising the arms, and the lower strength of the arms compared to the legs.

Figure 2:
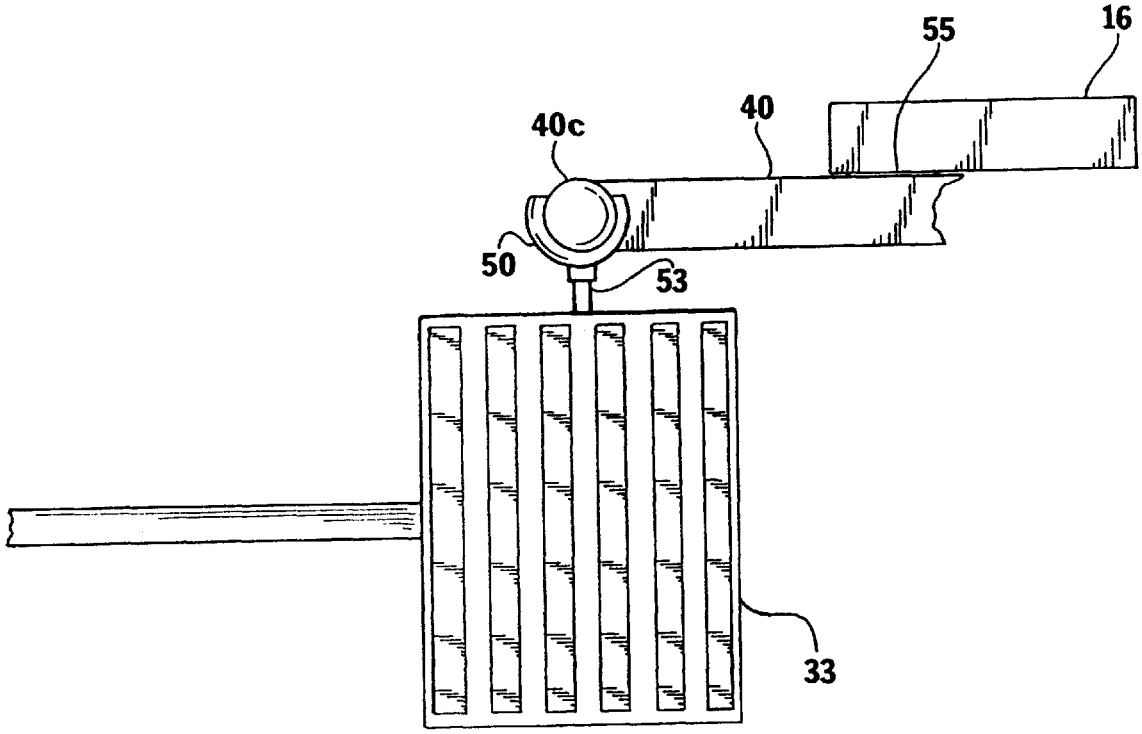
FIG. 2 is a top plan view, illustrating one of the pedals, and the attachment between said pedal and one of the guide tracks.

FIG 2 illustrates the interconnection between one of the guide tracks 40 and one of the actuating levers 33. As illustrated, the guide track 40 is an elliptical ring forming a closed loop and having a round cross section having circumference 40C. The circumference 40C is welded to the front support 16 at one or more weld points 55. The actuating lever 33 has a partial sleeve 50 which extends more than one hundred eighty degrees around the circumference, but less than three hundred sixty degrees around. Thus, the actuating lever 33 is held in place on the guide track 40, and is allowed freedom of motion around the elliptical loop of the guide track, without interference with the weld point 55.

The actuating lever 33 is attached to the partial sleeve 50 with a pivot assembly 53. The pivot assembly allows the sleeve to travel fully around the guide track 40 while the actuating lever 33 remains substantially parallel to the connecting lever 45.

Thus, to use the exercise device 10, the user stands upon the pedals, and grasps the handgrips. The user then begins moving the pedals and handgrips around their respective guide tracks 40. The flywheels 43 initially resist movement, and then regulate elliptical motion of the pedals and handgrips.

In conclusion, herein is presented an exercise device which simulates the elliptical motion of stair climbing for the legs, and which further allows simultaneous elliptical motion for the arms.

What is claimed is:

1. An exercise device, for exercising the arms and legs, comprising:

a base comprising a pair of base plates;

a frame comprising a front support and a rear support, the front support and rear support each extending substantially vertically from one of the base plates and meeting at an apex where the front support and rear support form an acute angle;

an upper exercise unit and a lower exercise unit, each exercise unit comprising a pair of elliptical guide tracks mounted to opposite sides of the front support, each guide track forming a closed elliptical loop, each exercise unit further having a pair of actuating levers and a partial sleeve attached onto the guide tracks for traveling around said loop, wherein the actuating levers are each pivotally attached to one of the partial sleeves.

2. The exercise device as recited in claim 1, wherein the actuating levers associated with the lower exercise unit are pedals and the actuating levers associated with the upper exercise unit are handgrips.

3. The exercise device as recited in claim 2, wherein each exercise unit further comprises a flywheel assembly, each flywheel assembly having a pair of flywheels and an axle, the flywheels mounted both mounted to the rear support on opposite sides thereof and attached by the axle extending through the rear support, each flywheel attached to one of the actuating levers by a connecting lever, the flywheels shaped and the connecting levers attached to the flywheels so as to permit elliptical movement around of the partial sleeves and thus the actuating levers around their respective guide tracks.

4. The exercise device as recited in claim 3, wherein the guide tracks comprise an elliptical ring with circular cross section having a circumference, and wherein each of said partial sleeves extends more than one hundred eighty degrees around said circumference but less than three hundred sixty degrees therearound.

5. The exercise device as recited in claim 4, wherein the front support and rear support form between a ten and thirty degree angle at the apex of the frame, and wherein the upper exercise unit and lower exercise unit are positioned on the frame so that an adult user can comfortably grasp the handgrips on the upper exercise unit while said user stands upon the pedals of the lower exercise unit.

6. The exercise device as recited in claim 5, wherein the front support has a front support left and a front support right, the rear support has a rear support left and a rear support right, wherein one flywheel for the upper exercise unit and lower exercise unit are located on each of the rear support left and rear support right, wherein one guide track for the upper exercise unit and lower exercise unit are located on each of the front support left and front support right, and wherein the actuating pedal connected to the guide track on the front support left is connected to the flywheel mounted on the rear support left by one of the connecting levers.

* * * * *